US005969566A

United States Patent [19]

Weber et al.

[11] Patent Number: 5,969,566

[45] Date of Patent: Oct. 19, 1999

[54] CIRCUIT CONFIGURATION FOR GENERATING A REFERENCE POTENTIAL

[75] Inventors: Stephan Weber, München; Udo Matter, Düsseldorf; Stefan Heinen, Krefeld, all of Germany

[73] Assignee: Siemens Aktiengesellschaft, Munich, Germany

[21] Appl. No.: 08/879,593

[22] Filed: Jun. 20, 1997

[30] Foreign Application Priority Data

Jun. 20, 1996 [DE] Germany ..... 196 24 676

[51] Int. Cl.[6] ..... G05F 1/10

[52] U.S. Cl. ..... 327/540; 327/538; 323/313

[58] Field of Search ..... 327/538, 540, 327/545; 323/312, 313, 315

[56] References Cited

U.S. PATENT DOCUMENTS

| | | | |
|---|---|---|---|
| 4,897,560 | 1/1990 | Saito et al. | 307/296 |
| 5,013,941 | 5/1991 | Jansson | 307/475 |
| 5,309,083 | 5/1994 | Pierret et al. | 323/313 |
| 5,381,083 | 1/1995 | Inamori et al. | 323/313 |
| 5,488,329 | 1/1996 | Ridgers | 327/539 |
| 5,719,522 | 2/1998 | Saitou et al. | 327/540 |
| 5,801,582 | 9/1998 | Weber | 327/539 |

FOREIGN PATENT DOCUMENTS

0426150 A2 5/1991 European Pat. Off. .

OTHER PUBLICATIONS

"Analysis and Design of Analog Integrated Circuits", Second Edition, Paul R. Gray et al., pp. 292–297.

*Primary Examiner*—Terry D. Cunningham
*Assistant Examiner*—Maria Hasanzadah
*Attorney, Agent, or Firm*—Herbert L. Lerner; Laurence A. Greenberg

[57] ABSTRACT

A circuit for generating a reference potential includes a first transistor having an emitter connected to a ground potential, a base, and a collector connected to the base; a second transistor having a base connected to the base of the first transistor; a first resistor connected between the collector of the first transistor and an output terminal outputting the reference potential; a second resistor connected between the collector of the second transistor and the output terminal; a third resistor connected between the emitter of the second transistor and ground potential; a third transistor having a base connected to the collector of the second transistor, and an emitter connected to the ground potential; a fourth transistor having a collector connected to a supply potential, an emitter connected to the output terminal, and a base connected to the collector of the third transistor; a first current source connected between the base and the collector of the fourth transistor; and a second current source connected in parallel with the first current source, the second current source generating a compensation current compensating for current fluctuations of the first current source.

12 Claims, 2 Drawing Sheets

CIRCUIT CONFIGURATION FOR GENERATING A REFERENCE POTENTIAL

BACKGROUND OF THE INVENTION

FIELD OF THE INVENTION

The invention relates to circuits for generating a reference potential. More specifically, the invention pertains to a circuit configuration for generating a reference potential with a first transistor, the emitter of which is connected to a ground potential and the base and collector of which are connected to one another; with a second transistor, the base of which is connected to the base of the first transistor; with a first resistor connected between the collector of the first transistor and an output terminal for picking up the reference potential; a second resistor connected between the collector of the second transistor and the output terminal; with a third resistor connected between the emitter of the second transistor and the ground potential; with a third transistor, the base of which is connected to the collector of the second transistor and the emitter of which is connected to the ground potential; with a fourth transistor, the collector of which is connected to the supply potential, the emitter of which is connected to the output terminal, and the base of which is connected to the collector of the third transistor; a first current source is connected between the base and the collector of the fourth transistor.

One such circuit configuration, also known as a band-gap reference voltage source, is known for instance from Paul R. Gray, Robert G. Meyer, "Analysis and Design of Analog Integrated Circuits", Second Edition 1984, pp. 293–296, and is used in many integrated circuits to supply other circuit blocks with a temperature-independent reference potential and/or a plurality of reference currents. In the future, it will moreover become increasingly important for integrated circuits to operate as independently as possible of the supply voltage, especially for battery-operated devices. In any actual transistor driven with a constant base-to-emitter voltage or a constant base current, the collector current, because of the so-called Early effect, fluctuates as a function of the collector-to-emitter voltage, which is often linked in turn directly to the supply voltage. The Early effect is described for instance in Paul R. Gray, Robert G. Meyer, "Analysis and Design of Analog Integrated Circuits", Second Edition 1984, pp. 17–19. This problem is also critical precisely because fast modern transistors tend to have poor properties in terms of the Early effect.

SUMMARY OF THE INVENTION

It is accordingly an object of the invention to provide a circuit configuration for generating a reference potential, which overcomes the above-mentioned disadvantages of the heretofore-known devices and methods of this general type and which the Early effect is compensated to the best possible extent.

With the foregoing and other objects in view there is provided, in accordance with the invention, a circuit configuration for generating a reference potential, comprising:

- a first transistor having an emitter connected to ground potential, a base, and a collector connected to the base;
- a second transistor having a base connected to the base of the first transistor;
- a first resistor connected between the collector of the first transistor and an output terminal outputting the reference potential;

- a second resistor connected between the collector of the second transistor and the output terminal;
- a third resistor connected between the emitter of the second transistor and ground potential;
- a third transistor having a base connected to the collector of the second transistor, and an emitter connected to the ground potential;
- a fourth transistor having a collector connected to a supply potential, an emitter connected to the output terminal, and a base connected to the collector of the third transistor;
- a first current source connected between the base and the collector of the fourth transistor; and
- a second current source connected in parallel with the first current source, the second current source generating a compensation current compensating for current fluctuations of the first current source.

It is a particular advantage of the invention that Early compensation is achieved at little expense in terms of circuitry.

In accordance with an additional feature of the invention, the second current source generates a compensation current equal to a difference, multiplied by a given factor, between a first Early-dependent current and a second, less Early-dependent current.

In accordance with another feature of the invention, the first current source includes a fifth resistor connected to the supply potential and a fifth transistor having an emitter connected to the supply potential via the fifth resistor, a collector connected to the base of the fourth transistor, and a base connected to the supply potential through a sixth resistor, and including a drive means or control means for generating, via the sixth resistor, a voltage dependent on a potential on the terminal.

In accordance with a further feature of the invention, there is provided:

- a drive or control means having a sixth transistor with a base connected to the base of the fifth transistor, an emitter connected to the supply potential with a seventh resistor interposed therebetween, a seventh transistor with a base connected to the output terminal, with an emitter connected to the ground potential via an eighth resistor, and with a collector connected to the collector of the sixth transistor;
- an eighth transistor with a collector-to-emitter path connected in parallel with a collector-to-emitter path of the seventh transistor and with a base;
- a ninth resistor connecting the base of the seventh transistor to the supply potential and a diode path and a tenth resistor connecting the base of the seventh transistor to ground potential;
- a ninth transistor with a collector coupled to the supply potential, an emitter coupled to the ground potential via a third current source, and a base coupled to the collector of the seventh transistor; and
- a tenth transistor with an emitter connected to the base of the fifth transistor, a collector connected to ground potential, and a base connected to the emitter of the ninth transistor.

In accordance with again an added feature of the invention, the third current source comprises an eleventh resistor connected to ground potential, and an eleventh transistor having an emitter connected via the eleventh resistor to ground potential, a collector connected to the emitter of the ninth transistor, and a base connected to the base of the eighth transistor.

In accordance with again an additional feature of the invention, the circuit configuration further comprises a current mirror having an input circuit and an output circuit, and wherein the second current source includes two mutually connected partial current sources for forming a first Early-dependent current and a second, less Early-dependent current, the partial current sources being connected to the supply potential and to the input circuit and the output circuit, respectively, of the current mirror, and including a third partial current source connected in parallel with the first current source and coupled, on an input side, with the two mutually connected partial current sources.

In accordance with again another feature of the invention, there is provided a current amplifier stage having an input and an output connected to the base of the ninth transistor, and including a node point defined between the output circuit of the current mirror and the second current source, the node point being connected to the input of the current amplifier stage.

In accordance with yet an added feature of the invention, the current amplifier stage comprises a second current mirror.

In accordance with yet another feature of the invention, the partial current sources are comprised of output branches of a current bank, and an input branch of the current bank is comprised of the sixth resistor.

In accordance with a concomitant feature of the invention, there is further provided:

a current bank having output branches forming the partial current sources and a twelfth resistor forming an input branch of the current bank; a twelfth transistor having a base-to-emitter path connected in series with a thirteenth resistor and in parallel with said twelfth resistor;

a thirteenth transistor having a base and a collector connected to the supply potential, and a fourteenth transistor having a collector, a base connected to said base of said seventh transistor, and an emitter connected to the ground potential via a fourteenth resistor, said base of said thirteenth transistor and said collector of said fourteenth transistor being coupled to said collector of said twelfth transistor;

a fifteenth transistor having a base connected to said emitter of said thirteenth transistor, a collector connected to ground potential, and an emitter connected to said base of said twelfth transistor; and a sixteenth transistor having a collector connected to said base of said fifteenth transistor, an emitter connected to ground potential via a fifteenth resistor, and a base coupled to said base of said eighth transistor.

Other features which are considered as characteristic for the invention are set forth in the appended claims.

Although the invention is illustrated and described herein as embodied in a circuit configuration for generating a reference potential, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
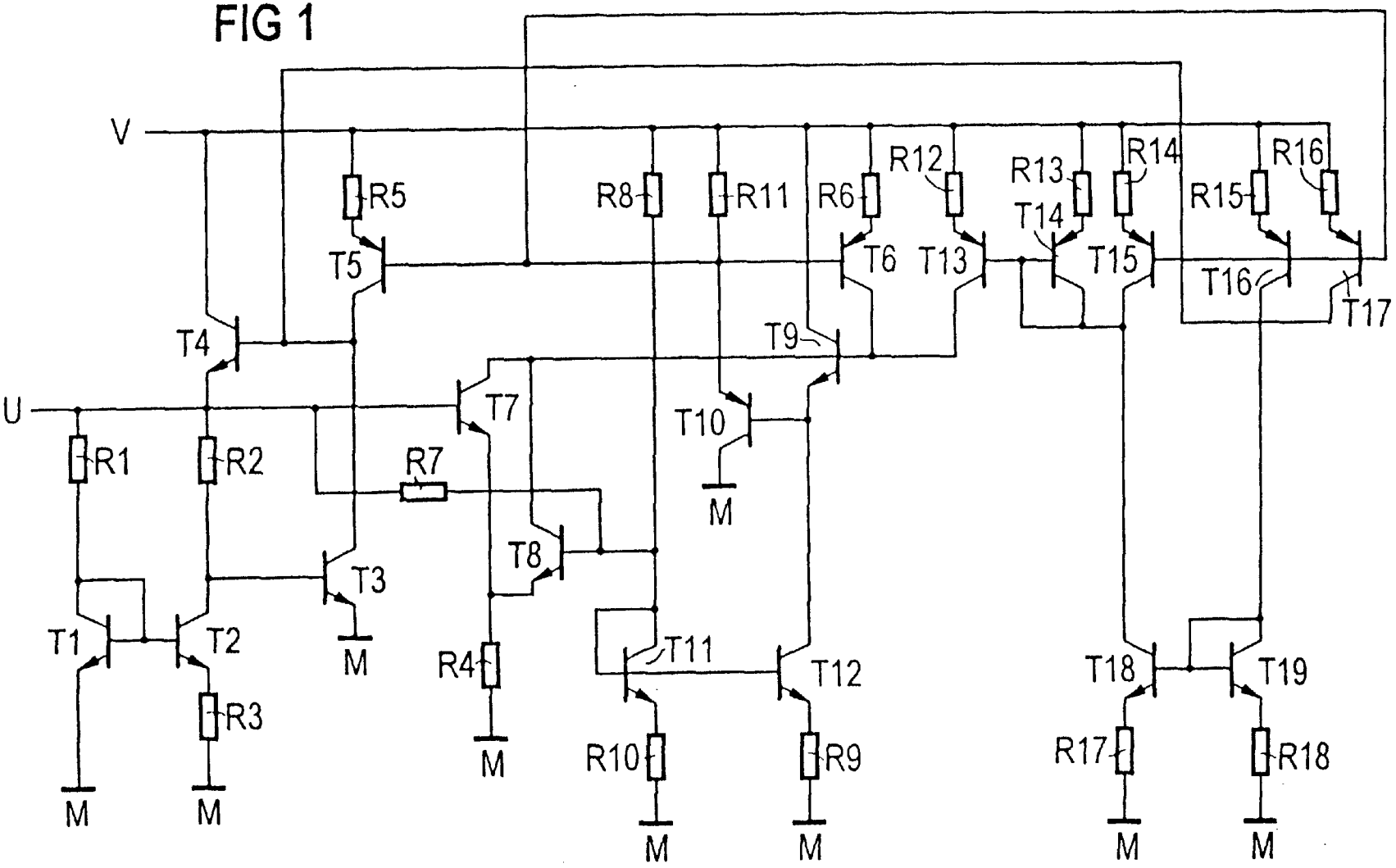
FIG. 1 is a circuit diagram of a first embodiment of the circuit according to the invention.

Referring now to the figures of the drawing in detail and first, particularly, to FIG. 1 thereof, there is seen a first exemplary embodiment with an npn transistor T1, whose emitter is connected to ground potential M and whose base and collector are interconnected and are coupled via a common resistor R1 to an output terminal U that carries a reference potential. The base of an npn transistor T2 is connected to the base and the collector of the transistor T1. The emitter of the transistor T2 is coupled to the ground potential M via a resistor R3. The collector of T2 is coupled to the output terminal U via a resistor R2.

Also connected to the output terminal U is the emitter of an npn transistor T4, whose collector is connected to a supply potential V. The base of the transistor T4 is connected to the collector of an npn transistor T3, whose emitter is connected to the ground potential M and whose base is connected to the collector of the transistor T2.

The base of the transistor T4 is also connected, via a current source circuit, to the supply potential V. The current source circuit has a pnp transistor T5, whose emitter is connected to the supply potential V via a resistor R5 and whose collector is connected to the base of the transistor T4 and to the collector of the transistor T3. The base of the transistor T5 is connected to the base of a pnp transistor T6, whose emitter is coupled to the supply potential V via a resistor R6, and whose collector is coupled to the base of a transistor T9. The collector of the transistor T6 is moreover connected to the collector of an npn transistor T7, whose emitter is connected to the ground potential M via a resistor R4 and whose base is connected to the output terminal U. The collector-to-emitter path of an npn transistor T8 is also connected parallel to the collector-to-emitter path of the transistor T7. The base of the transistor T8 is connected to the supply potential V, with the interposition of a resistor R8. The base of the transistor T8 is also connected to the input branch of a current mirror. The input branch is formed by an npn transistor T11, whose base and collector are connected both to one another and to the base of the transistor T8 and whose emitter is connected to the ground potential M, with the interposition of a resistor 10. The bases of the transistors T7 and T8 are also coupled to one another via a resistor R7. The output branch of the current mirror is formed by an npn transistor T12, whose base is connected to the base of the transistor T11 and whose emitter is connected to the ground potential M with the interposition of a resistor R9. The collector of the transistor T12 is carried to the base of a pnp transistor T10, whose collector is connected to the ground potential M and whose emitter is connected to the bases of the transistors T5 and T6, and to the emitter of an npn transistor T9, whose collector is connected to the supply potential V and whose base is connected to the collector of the transistor T6. Finally, a resistor R11 is connected between the bases of the transistors T5 and T6 on the one hand and the supply potential V on the other hand.

The collector of a pnp transistor T13 is connected to the collector of the transistor T6. The emitter of T13 is connected to the supply potential V via a resistor R12 and its base is coupled to the base and collector of a pnp transistor T14, to the collector of a pnp transistor T15, and to the collector of an npn transistor T18. The emitters of the two transistors T14 and T15 are connected to the supply potential V, each via a respective resistor T13 and R14. The emitter of the transistor T18 is connected to the ground potential M via a resistor R17. The transistor T15, like the pnp transistors T16 and T17, whose emitters are connected to the supply potential V each via a respective resistor R15 and R16, forms output branches of a current mirror, whose input branch is formed by the resistor R11. To that end, the bases of the transistors T15, T16 and T17 are coupled to the bases of the transistors T5 and T6. The collector of the transistor T16 is connected to the base and collector of an npn transistor T19 and to the base of the transistor T18. The emitter of the transistor T19 is coupled to the ground potential M via a resistor R18. The collector of the transistor T17, finally, is connected to the base of the transistor T4.

Figure 2:
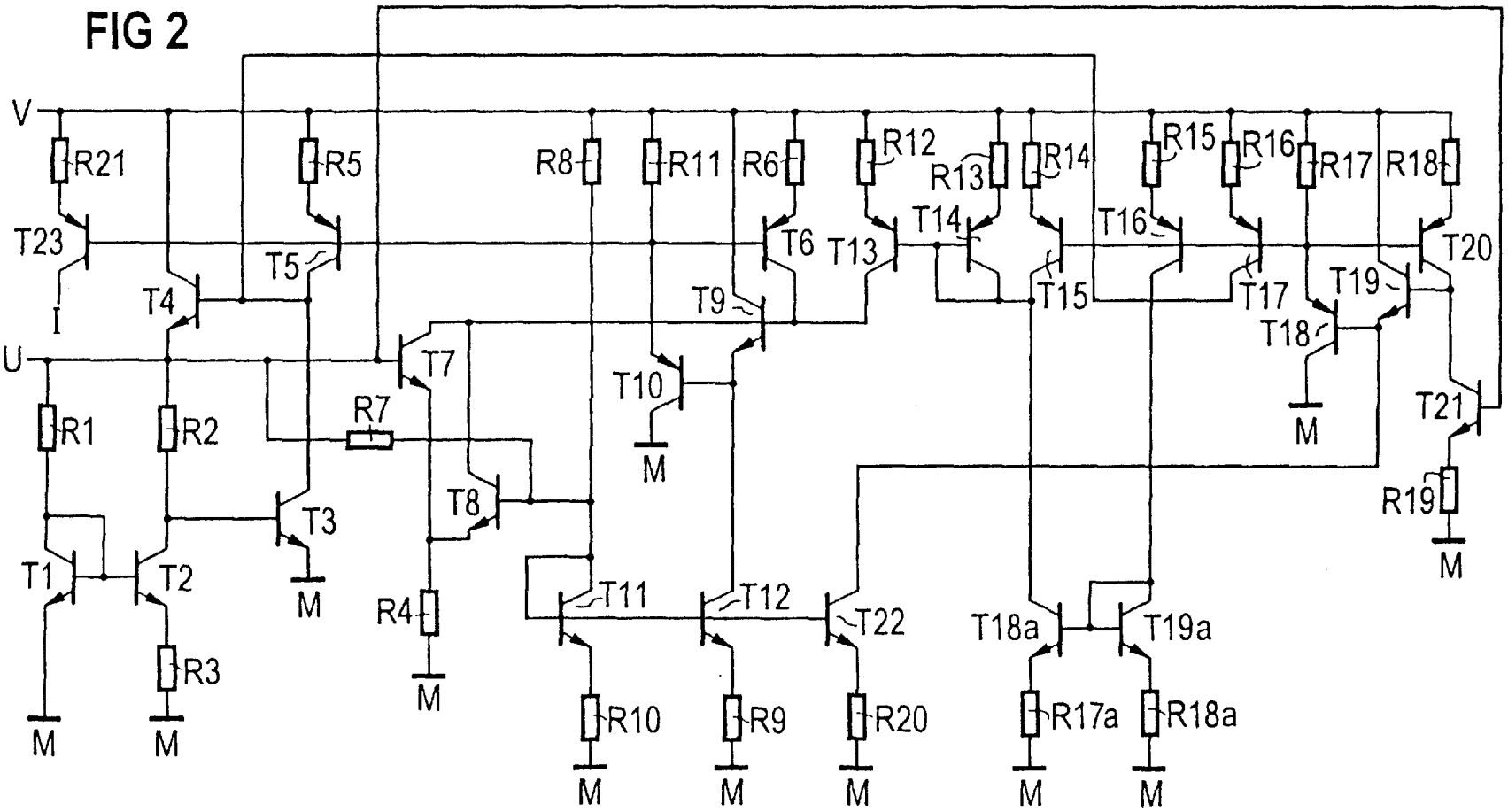
FIG. 2 is a similar diagram of a second embodiment thereof.

Referring now to FIG. 2, the embodiment illustrated therein is modified relative to the exemplary embodiment of FIG. 1, such that the bases of the transistors T15, T16 and T17 are connected to the supply potential V not via the resistor R11 but rather via a resistor R17. In addition, the bases of the transistors T15, T16, T17 are connected both to the emitter of a pnp transistor T18 and the base of a pnp transistor T20. The collector of the transistor T18 is connected to the ground potential M. The collector of the transistor T20 is connected on the one hand to the base of an npn transistor T19, whose collector is connected to the supply potential V, and on the other to the collector of a transistor T21, whose base is coupled to the terminal U and whose emitter is coupled to the ground potential M with the interposition of a resistor R19. The base of the transistor T18 and the emitter of the transistor T19 are connected together to the collector of an npn transistor T22, whose emitter is connected to the ground potential M via a resistor R20 and whose base is coupled to the bases of the transistors T11 and T12.

Finally, to enable also generating a reference output current, a pnp transistor T23 is provided, whose base is connected to the base of the transistor T5 and whose emitter is connected to the supply potential V via a resistor R21. The collector is connected to an output terminal I, at which the reference current can be picked up.

The separate optimization of the operating voltage suppression, both in view of the band-gap reference potential at the output U and the reference output current at the terminal I, can be done separately by adjusting the emitter area of the transistor T14 in proportion to the emitter area of the transistor T13, and by adapting the resistors R17 and R18. A lower resistance of the two resistors R17 and R18 results in a weaker negative feedback of current, so that the Early voltage correction is correspondingly more pronounced. A drop in the output current, for instance, can also be established, if it is important to provide a rate action. Moreover, separate, optionally interruptible current output stages may be provided, which through further current outputs of the current bank formed of the transistors T13 and T14 in combination with the resistors R12 and R13 can be utilized for Early compensation of the output stages.

As can be seen, a compensation current is superimposed on the output current of the current source formed by the transistor T5 in combination with the resistor R5, in that the output current of the current source formed by the transistor T17 in combination with the resistor R16 is likewise fed into the base of the transistor T4, and the input circuit of the transistor T15 is varied via the transistors T9–T14. Specifically, as the supply voltage increases, the output current defined by the collector current of the transistor T5 increases as well. The reason for this is primarily the early voltage dependency of the collector currents of the transistors T5–T12. Via the transistor T4, this dependency is directly expressed at the output terminal U. The compensation current superimposed on it is now formed from the difference between a first Early-dependent current of the current source having the transistor T16 in combination with the resistor R15 and a less Early-dependent current of the current source having the transistor T15 in combination with the resistor R14, this difference being multiplied by a factor that is provided by the current ratio of the transistors T13 and T14 an the ratio of the resistors R17 and R18. The dimensioning is selected such that a linear dependency of the compensation current is attained, and thus overall independence from the supply voltage is achieved.

We claim:

1. A circuit configuration for generating a reference potential, comprising:

a first transistor having an emitter connected to a ground potential, a base, and a collector connected to said base;

a second transistor having a base connected to said base of said first transistor, a collector and an emitter;

a first resistor connected between said collector of said first transistor and an output terminal outputting the reference potential;

a second resistor connected between said collector of said second transistor and said output terminal;

a third resistor connected between said emitter of said second transistor and ground potential;

a third transistor having a base connected to said collector of said second transistor, an emitter connected to the ground potential and a collector;

a fourth transistor having a collector connected to a supply potential, an emitter connected to said output terminal, and a base connected to said collector of said third transistor;

a first current source connected between said base and said collector of said fourth transistor;

a second current source connected in parallel with said first current source, said second current source generating a compensation current compensating for current fluctuations of said first current source; and a controller responsive to an output at said output terminal for providing control to said first and second current sources.

2. The circuit configuration according to claim 1, wherein said second current source is adapted to generate a compensation current equal to a difference, multiplied by a given factor, between a first Early-dependent current and a second, less Early-dependent current.

3. The circuit configuration according to claim 1, wherein said first current source includes a fifth resistor connected to the supply potential and a fifth transistor having an emitter connected to the supply potential via said fifth resistor, a collector connected to said base of said fourth transistor, and a base connected to the supply potential through a sixth resistor, and including a drive means for generating, via said sixth resistor, a voltage dependent on a potential on said output terminal.

4. The circuit configuration according to claim 3, which further comprises:

sixth, seventh and eighth transistors, said sixth transistor having a base connected to said base of said fifth transistor, an emitter connected to the supply potential via said seventh resistor and a collector, said seventh transistor having a base connected to said output terminal and a collector-to-emitter path, an emitter connected to the ground potential via said eighth resistor, and a collector connected to said collector of said sixth transistor;

said eighth transistor having a collector-to-emitter path connected in parallel with said collector-to-emitter path of said seventh transistor and a base;

a ninth resistor connected between said base of said eighth transistor and the supply potential;

a tenth transistor;

an eleventh transistor having a base-to-emitter path connected between said eighth transistor and via said tenth resistor to ground potential, said base of said eighth transistor connected to said base of the said seventh transistor via said fourth resistor;

said ninth transistor having a collector coupled to the supply potential, an emitter coupled to the ground potential via a third current source, and a base coupled to said collector of said seventh transistor; and said tenth transistor having an emitter connected to said base of said fifth transistor, a collector connected to ground potential, and a base connected to said emitter of said ninth transistor.

5. The circuit configuration according to claim 4, wherein said third current source comprises an eleventh resistor connected to ground potential, and an eleventh transistor having an emitter connected via said eleventh resistor to ground potential, a collector connected to said emitter of said ninth transistor, and a base connected to said base of said eighth transistor.

6. The circuit configuration according to claim 1, which further comprises a current mirror having an input circuit and an output circuit, and wherein said second current source includes two mutually connected partial current sources for forming a first Early-dependent current and a second, less Early-dependent current, said partial current sources being connected to the supply potential and to said input circuit and said output circuit, respectively, of said current mirror, and wherein said two partial current sources are coupled, on an input side, with said second current source.

7. The circuit configuration according to claim 6, which further comprises a current amplifier stage having an input and an output connected to said base of said ninth transistor, and including a node point defined between said output circuit of said current mirror and said two partial current sources, said node point being connected to said input of said current amplifier stage.

8. The circuit configuration according to claim 7, wherein said current amplifier stage comprises a second current mirror.

9. The circuit configuration according to claim 6, wherein said current amplifier stage comprises a second current mirror.

10. The circuit configuration according to claim 6, wherein said partial current sources are comprised of output branches of a current bank, and an input branch of the current bank is comprised of said sixth resistor.

11. The circuit configuration according to claim 6, which further comprises:

a current bank having output branches forming said partial current sources and a twelfth resistor forming an input branch of said current bank; a twelfth transistor having a base-to-emitter path connected in series with a thirteenth resistor and in parallel with said twelfth resistor;

a thirteenth transistor having a base and a collector connected to the supply potential, and a fourteenth transistor having a collector, a base connected to said base of said seventh transistor, and an emitter connected to the ground potential via a fourteenth resistor, said base of said thirteenth transistor and said collector of said fourteenth transistor being coupled to said collector of said twelfth transistor;

a fifteenth transistor having a base connected to an emitter of said thirteenth transistor, a collector connected to ground potential, and an emitter connected to a base of said twelfth transistor; and a sixteenth transistor having a collector connected to said base of said fifteenth transistor, an emitter connected to ground potential via a fifteenth resistor, and a base coupled to said base of said eighth transistor.

12. A circuit configuration for generating a reference potential, comprising:

a first transistor having an emitter connected to a ground potential, a base, and a collector connected to said base;

a second transistor having a base connected to said base of said first transistor a collector and an emitter;

a first resistor connected between said collector of said first transistor and an output terminal outputting the reference potential;

a second resistor connected between said collector of said second transistor and said output terminal;

a third resistor connected between said emitter of said second transistor and ground potential;

a third transistor having a base connected to said collector of said second transistor, and an emitter connected to the ground potential;

a fourth transistor having a collector connected to a supply potential, an emitter connected to said output terminal, and a base connected to a collector of said third transistor;

a fourth resistor coupled to said emitter of said fourth transistor and to said second resistor;

a first current source connected between said base and said collector of said fourth transistor;

a second current source connected in parallel with said first current source, said second current source generating a compensation current compensating for current fluctuations of said first current source; and a controller responsive to an output at said output terminal for providing control to said first and second current sources.

* * * * *